US006677281B2

(12) United States Patent
Givens, Jr. et al.

(10) Patent No.: US 6,677,281 B2
(45) Date of Patent: Jan. 13, 2004

(54) SYNERGISTIC COMBINATION OF METALLIC AND ASHLESS RUST INHIBITORS TO YIELD IMPROVED RUST PROTECTION AND DEMULSIBILITY IN DISPERSANT-CONTAINING LUBRICANTS

(75) Inventors: Willie Allan Givens, Jr., Glassboro, NJ (US); Angela Stefana Galiano-Roth, Mullica Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/104,690

(22) Filed: Mar. 22, 2002

(65) Prior Publication Data

US 2003/0027726 A1 Feb. 6, 2003

Related U.S. Application Data

(60) Provisional application No. 60/296,916, filed on Jun. 8, 2001, and provisional application No. 60/285,109, filed on Apr. 20, 2001.

(51) Int. Cl.[7] ..... C10M 14/12

(52) U.S. Cl. ..... 508/185; 508/291; 508/295; 508/390

(58) Field of Search ..... 508/185, 291, 508/295, 390

(56) References Cited

U.S. PATENT DOCUMENTS

| | | | | |
|---|---|---|---|---|
| 3,254,025 A | | 5/1966 | Le Suer | 252/32.7 |
| 3,661,622 A | * | 5/1972 | Rogers | 428/467 |
| 3,671,012 A | * | 6/1972 | Scott et al. | 508/393 |
| 3,720,615 A | * | 3/1973 | Izumi et al. | 508/306 |
| 4,010,107 A | * | 3/1977 | Rothert | 508/294 |
| 4,159,956 A | | 7/1979 | de Vries | 252/33.4 |
| 4,419,252 A | | 12/1983 | Shim | 252/32.7 |
| 4,493,776 A | * | 1/1985 | Rhodes | 508/287 |
| 5,137,980 A | | 8/1992 | DeGonia et al. | 525/327.6 |
| 5,262,073 A | * | 11/1993 | Schmitt et al. | 508/287 |
| 5,312,554 A | * | 5/1994 | Waddoups et al. | 508/189 |
| 5,334,318 A | | 8/1994 | Vinci et al. | 252/38 |
| 5,498,353 A | * | 3/1996 | Lin et al. | 508/189 |
| 5,525,247 A | | 6/1996 | Miyaji et al. | 252/18 |
| 5,656,582 A | | 8/1997 | Shiraishi et al. | 508/108 |
| 5,672,570 A | | 9/1997 | Miyaji et al. | 508/192 |
| 5,789,356 A | * | 8/1998 | Tiffany, III | 508/293 |
| 5,888,948 A | * | 3/1999 | Meny et al. | 508/591 |
| 5,942,472 A | | 8/1999 | Watts et al. | 508/291 |
| 5,962,377 A | | 10/1999 | Baumgart et al. | 508/168 |
| 5,962,378 A | | 10/1999 | Tiffany et al. | 508/293 |
| 6,001,780 A | | 12/1999 | Ho et al. | 508/192 |

FOREIGN PATENT DOCUMENTS

| | | | |
|---|---|---|---|
| CN | 85102059 | 4/1985 | |
| EP | 0096539 A2 | 12/1983 | C10M/1/08 |
| EP | 0113045 A1 | 7/1984 | C10M/1/48 |
| EP | 0208560 A2 | 1/1987 | C10M/129/93 |
| EP | 0307132 A1 | 3/1989 | C10M/133/52 |
| EP | 0462319 A1 | 12/1991 | C10M/163/00 |
| EP | 0686689 A2 | 12/1995 | C10M/141/10 |
| EP | 0721978 A2 | 7/1996 | C10M/169/04 |
| EP | 0976810 A1 | 2/2000 | C10M/135/10 |
| RO | 104845 | 6/1989 | |
| SU | 1421762 | 10/1986 | |
| WO | WO 88/03552 | 5/1988 | C10M/14/08 |
| WO | WO 94/13762 | 6/1994 | C10M/129/95 |
| WO | WO 95/10584 | 4/1995 | C10M/141/08 |
| WO | WO 96/35765 | 11/1996 | C10M/135/10 |
| WO | WO 97/12016 | 4/1997 | C10M/163/00 |

OTHER PUBLICATIONS

D. Clark et al., "New Generation of Ashless Top Tier Hydraulic Fluids", Journal of the Society of Tribologist and Lubrication Engineers, Apr. 2000, pp. 22–23.

Helen Ryan, Ethyl Petroleum Additives Ltd., Use of Group II, Group III Base Stocks in Hydraulic and Industrial Applications, 5th Annual Fuels & Lubes Asia Conference, pp. 1–17.

Fessenbeck et al., "Additives for Environmentally Acceptable Lubricants", National Lubricating Grease Institute, V 60, Sep. 6, 1996, pp. 9–25 (Abstract only).

H. Huang et al., "Study on Rustproofing Lubricating Oil 801", Journal –Runhua Yu Mifeng (1982), (4), pp. 16–21, Chinese Language.

* cited by examiner

*Primary Examiner*—Jacqueline V. Howard
(74) *Attorney, Agent, or Firm*—Estelle C. Bakun

(57) ABSTRACT

A lubricant having improved rust protection and demulsibility has a specific balance of an ashless dispersant and a rust inhibitor additive combination comprising a metallic and ashless rust inhibitor.

13 Claims, No Drawings

SYNERGISTIC COMBINATION OF METALLIC AND ASHLESS RUST INHIBITORS TO YIELD IMPROVED RUST PROTECTION AND DEMULSIBILITY IN DISPERSANT-CONTAINING LUBRICANTS

This application claims the benefit of U.S. Provisional Application(s) No(s).: APPLICATION NO(S).: 60/296,916 filed Jun. 8, 2001 and 60/285,109 filed Apr. 20, 2001.

FIELD OF INVENTION

The present invention relates to industrial lubricants. More specifically the invention relates to lubricants for industrial machinery that provides improved rust protection, deposit control and demulsibility.

BACKGROUND

The art of lubricating oil formulation has become more complex with ever more stringent standards dictated by the increasing complexity of industrial equipment technology. For example, industrial oils and circulating oils such as compressor, gear, and hydraulic oils typically are required to be capable of separating from water in order that any water contamination arising during use does not adversely impact equipment operation and durability. In addition to industrial lubricants having demulsification properties, these oils are also required to be thermally and oxidatively stable in order to minimize deposit formation caused by degradation products. To further enhance deposit control performance industrial lubricants typically employ dispersants to keep deposit-forming precursors suspended in the bulk oil and away from working surfaces. Dispersants, however, tend to be effective in emulsifying water in the oil phase. Thus, additives that may enhance one property may adversely effect another property.

Another required property of industrial oils is rust inhibition.

An object of the present invention therefore is to provide an industrial lubricant that provides rust protection, deposit control and is capable of demulsifying water.

SUMMARY OF INVENTION

It has now been found that a specific balance of a metallic and ashless rust inhibitor and a dispersant provides improved anti-rust and demulsibility performance. Accordingly, in one embodiment, a lubricant composition is provided comprising:

(a) a lubricating oil basestock;

(b) an effective amount of a rust inhibitor additive combination consisting essentially of a metal containing rust inhibitor and an ashless rust inhibitor; and (c) an ashless polyolefin dispersant wherein the weight ratio of dispersant to rust inhibitor additive combination is less than 1.14.

Other embodiments of the invention will become apparent from the detailed description which follows.

DETAILED DESCRIPTION OF INVENTION

The lubricating oil basestock comprising a major portion of the composition of the present invention has a viscosity in the ISO 10–1500 viscosity grade range and preferably ISO 32 to 680 viscosity grade range. Individual oils meeting this viscosity requirement can be used or a mixture of oils of different viscosities can be combined. Preferably the basestock will be selected from any of the natural mineral oils of API Group II basestocks.

The lubricant composition also includes an effective amount of a rust inhibitor additive combination consisting essentially of a metal containing rust inhibitor and an ashless rust inhibitor. In the combination the metal containing rust inhibitor preferably is selected from Group 2*a* metal sulfonates. Indeed, the preferred metal sulfonates are calcium and barium alkylaryl sulfonates. Examples of such sulfonates include calcium dinonyl naphthalene sulfonate, barium dinonyl naphthalene sulfonate, and neutral calcium sulfonate.

The metal sulfonate typically is used in an amount in the range of about 0.20 to about 0.50 wt % based on the lubricating composition and preferably in the range of 0.20 to 0.30 wt %.

Combined with the metal sulfonate rust inhibitor is an ashless rust inhibitor. The ashless rust inhibitor preferably is an alkenyl succinimide, especially alkenyl succinimides having alkenyl groups of from about 15 to about 30 carbon atoms.

The ashless rust inhibitor typically is used in an amount in the range of from about 0.05 to about 0.30 wt % based on the lubricating composition.

The composition of the present invention includes an ashless polyolefin dispersant. Preferred polyolefin dispersants include homo- and copolymers of ethylene, propylene, butylene, isobutylene, pentene and the like. These polymer dispersants will have weight average molecular weights in the range of about 800 to about 5000 and preferably from about 2000 to about 2500. Preferably the dispersant is borated. Indeed, an especially preferred borated ashless dispersant is a borated polyisobutylene having a weight average molecular weight in the range of about 2000 to about 2500.

Unexpectedly it has been found that the weight ratio of dispersant to rust inhibitor combination should be less than 1.14 and preferably in the range of 0.55 to 1.14.

Other conventional additives which can be used in the lubricants of this invention include oxidation inhibitors, antifoam agents, viscosity index improvers, pour point depressants, and the like. These include hindered phenols, alkylated diphenyl amines, benzotriaozole derivatives, silicone oils and the like.

In general these other additives can be used in total amounts ranging from about 1.5 to 5 wt %.

EXAMPLE

A series of industrial lubricants were formulated and evaluated for rust performance and emulsion properties. The compositions and the test results are given in the Table. Referring to blends 1 to 15, it can be seen that using only a metal containing rust inhibitor with or without an ashless dispersant, unacceptable antirust performance was obtained.

Blends 16 to 18 demonstrate a need for higher levels of metal rust inhibitor to yield acceptable demulsification at higher levels of ashless dispersant.

Blends 20 through 24 showed unacceptable antirust performance of the metallic rust inhibitor at various treat levels while using a more demulsifiable lower molecular weight Mannich dispersant.

Blends 25 through 29 demonstrate some level of the metallic rust inhibitor is necessary to impart acceptable demulsibility. In the presence of ashless dispersant, a wide range of treat rates of the ashless rust inhibitor alone give poor demulsibility.

Blends 30 through 36 indicate a specific balance of combined rust inhibitor and dispersant is required to optimize antirust and demulsibility performance. The ratio of dispersant to rust inhibitor should not exceed 1.14. Results indicate a 0.8 ratio is optimal (Blend 36).

TABLE

| Formulations (a) Blend ID | | 1 | 2 | 3 | 4 | 5 | 7 |
|---|---|---|---|---|---|---|---|
| ISO Viscosity Grade | ISO | 32 | 32 | 32 | 32 | 32 | 68 |
| Mannich Dispersant① | | | | | | | |
| PIB Dispersant② | PARABAR 9260 | 0 | 0 | 0 | 0.2 | 0.2 | 0.2 |
| Ashless RI③ | | | | | | | |
| Ca Sulfonate RI④ | | 0.15 | 0.3 | 0.5 | 0.1 | 0.25 | 0.2 |
| ASTM Test | | | | | | | |
| MIDAS$Sample_Description | | | | | | | |
| D 4453 | KV @ 40° C., cSt | 29.68 | 29.8 | 29.89 | 33.67 | 33.67 | 66.39 |
| D 4455 | KV @ 100° C., cSt | | | | | | |
| D 6653 Rust Test-syn sea water | | Severe | Severe | Severe | Severe | Severe | |
| D 6653 | % Rust | 80, 35 | 70 | 50, 20 | 30 | 10 | |
| D 6654 Rust Test | 48 hours | | | | | Moderate | Severe |
| D 6654 | % Rust | | | | | 5 | 80 |
| D 1401 (37 ml water time, min.) | Characteristics @ 54° C. | 5 | 10 | 10 | >60, >60 | 5 | 5 |
| D 1401 (emulsion, min.) | Characteristics @ 54° C. | 5 | 10 | 10 | >60, >60 | 5 | 5 |
| D 1401 (time, minutes) | Characteristics @ 54° C. | 5 | 10 | 15 | >60, >60 | 10 | 10 |

| Formulations (a) Blend ID | | 8 | 9 | 10 | 11 | 13 | 14 |
|---|---|---|---|---|---|---|---|
| ISO Viscosity Grade | ISO | 68 | 68 | 32 | 32 | 32 | 32 |
| Mannich Dispersant① | | | | | | | |
| PIB Dispersant② | PARABAR 9260 | 0.2 | 0.2 | 0.25 | 0.3 | 0.5 | 0.25 |
| Ashless RI③ | | | | | | | |
| Ca Sulfonate RI④ | | 0.4 | 0.6 | 0.5 | 0.1 | 0.25 | 0.2 |
| ASTM Test | | | | | | | |
| MIDAS$Sample_Description | | | | | | | |
| D 4453 | KV @ 40° C., cSt | 66.72 | 66.91 | 34.07 | 32.63 | 34.39 | 34.55 |
| D 4455 | KV @ 100° C., cSt | | | | | | |
| D 6653 Rust Test-syn sea water | | | | Severe | Severe | Moderate | Severe |
| D 6653 | % Rust | | | 10 | 40 | 5 | 50 |
| D 6654 Rust Test | 48 hours | Severe | Severe | Severe | | Severe | |
| D 6654 | % Rust | 60 | 50 | 15 | | 10 | |
| D 1401 (37 ml water time, min.) | Characteristics @ 54° C. | 5 | 15 | 10 | 5 | 10 | >60 |
| D 1401 (emulsion, min.) | Characteristics @ 54° C. | 5 | 15 | 0 | 5 | 10 | >60 |
| D 1401 (time, minutes) | Characteristics @ 54° C. | 10 | 20 | 15 | 10 | 10 | >60 |

| Formulations (a) Blend ID | | 15 | 19 | 16 | 17 | 18 | 20 |
|---|---|---|---|---|---|---|---|
| ISO Viscosity Grade | ISO | 32 | 32 | 68 | 68 | 68 | 32 |
| Mannich Dispersant① | | | | | | | 0.2 |
| PIB Dispersant② | PARABAR 9260 | 0.6 | 0.6 | 0.6 | 0.6 | 0.6 | |
| Ashless RI③ | | | | | | | |
| Ca Sulfonate RI④ | | 0.45 | 0.9 | 0.2 | 0.4 | 0.6 | 0.25 |
| ASTM Test | | | | | | | |
| MIDAS$Sample_Description | | | | | | | |
| D 4453 | KV @ 40° C., cSt | 34.66 | 34.96 | 68.09 | 68.44 | 68.73 | 33.61 |
| D 4455 | KV @ 100° C., cSt | | | | | | |
| D 6653 Rust Test-syn sea water | | Moderate | Pass | | | | Severe |
| D 6653 | % Rust | 4 | | | | | 6 |
| D 6654 Rust Test | 48 hours | | | Severe | Severe | Severe | Pass |
| D 6654 | % Rust | | | 40 | 40 | 20 | |
| D 1401 (37 ml water time, min.) | Characteristics @ 54° C. | 5, 5 | 15, 15 | >60 | 25 | 5 | 5 |
| D 1401 (emulsion, min.) | Characteristics @ 54° C. | 5, 5 | 15, 15 | >60 | 25 | 5 | 5 |
| D 1401 (time, minutes) | Characteristics @ 54° C. | 10, 10 | 20, 20 | >60 | 30 | 10 | 10 |

| Formulations (a) Blend ID | | 21 | 22 | 23 | 24 | 25 | 26 |
|---|---|---|---|---|---|---|---|
| ISO Viscosity Grade | ISO | 32 | 32 | 32 | 32 | 46 | 46 |
| Mannich Dispersant① | | 0.4 | 0.6 | 0.4 | 0.4 | 0.2 | 0.4 |
| PIB Dispersant② | PARABAR 9260 | | | | | | |
| Ashless RI③ | | | | | | | |
| Ca Sulfonate RI④ | | 0.25 | 0.25 | 0.3 | 0.5 | 0.05 | 0.05 |
| ASTM Test | | | | | | | |
| MIDAS$Sample_Description | | | | | | | |
| D 4453 | KV @ 40° C., cSt | 33.92 | 34.32 | 34 | 34.12 | 44.63 | 44.87 |
| D 4455 | KV @ 100° C., cSt | | | | | 6.938 | 6.99 |
| D 6653 Rust Test-syn sea water | | Severe | Moderate | Severe | Pass | | |
| D 6653 | % Rust | 6 | 6 | 6 | | | |

TABLE-continued

| | | | | | | | |
|---|---|---|---|---|---|---|---|
| D 6654 Rust Test | 48 hours | Pass | | Pass | Pass | | |
| D 6654 | % Rust | | | | | | |
| D 1401 (37 ml water time, min.) | Characteristics @ 54° C. | 5 | 5 | 5 | 10 | >60 | >60 |
| D 1401 (emulsion, min.) | Characteristics @ 54° C. | 10 | 5 | 5 | 10 | >60 | >60 |
| D 1401 (time, minutes) | Characteristics @ 54° C. | 10 | 10 | 10 | 15 | >60 | >60 |
| Formulations (a) | | | | | | | |
| Blend ID | | 27 | 28 | 29 | 30 | 31 | 32 |
| ISO Viscosity Grade | ISO | 46 | 46 | 32 | 46 | 46 | 46 |
| Mannich Dispersant① | | 0.2 | 0.4 | 0.4 | | | |
| PIB Dispersant② | PARABAR 9260 | | | | 0.4 | 0.4 | 0.4 |
| Ashless RI③ | | 0.1 | 0.1 | 0.3 | 0.05 | 0.05 | 0.05 |
| Ca Sulfonate RI④ | | | | | 0.1 | 0.2 | 0.3 |
| ASTM Test | | | | | | | |
| MIDAS$Sample_Description | | | | | | | |
| D 4453 | KV @ 40° C., cSt | 44.34 | 44.72 | | 45.12 | 45.18 | 45.21 |
| D 4455 | KV @ 100° C., cSt | 6.956 | 7.003 | | 7.041 | 7.047 | 7.007 |
| D 6653 Rust Test-syn sea water | | | | | Severe | Severe | Pass |
| D 6653 | % Rust | | | | 30 | 10 | |
| D 6654 Rust Test | 48 hours | | | | | | |
| D 6654 | % Rust | | | | | | |
| D 1401 (37 ml water time, min.) | Characteristics @ 54° C. | >60 | >60 | >60 | >60 | >60 | 5 |
| D 1401 (emulsion, min.) | Characteristics @ 54° C. | >60 | >60 | >60 | >60 | >60 | 5 |
| D 1401 (time, minutes) | Characteristics @ 54° C. | >60 | >60 | >60 | >60 | >60 | 5 |

| | | | | | |
|---|---|---|---|---|---|
| Formulations (a) | | | | | |
| Blend ID | | 33 | 34 | 35 | 36 |
| ISO Viscosity Grade | ISO | 46 | 46 | 46 | 46 |
| Mannich Dispersant① | | | | | |
| PIB Dispersant② | PARABAR 9260 | 0.2 | 0.2 | 0.2 | 0.2 |
| Ashless RI③ | | 0.05 | 0.05 | 0.05 | 0.05 |
| Ca Sulfonate RI④ | | 0.1 | 0.3 | 0.3 | 0.2 |
| ASTM Test | | | | | |
| MIDAS$Sample_Description | | | | | |
| D 4453 | KV @ 40° C., cSt | 44.56 | 44.65 | 44.76 | 44.71 |
| D 4455 | KV @ 100° C., cSt | 6.979 | 6.981 | 6.952 | 6.985 |
| D 6653 Rust Test-syn sea water | | Severe | Light | Pass | Pass |
| D 6653 | % Rust | 20 | 3 | | |
| D 6654 Rust Test | 48 hours | | | | |
| D 6654 | % Rust | | | | |
| D 1401 (37 ml water time, min.) | Characteristics @ 54° C. | >60 | 5 | 5 | 5 |
| D 1401 (emulsion, min.) | Characteristics @ 54° C. | >60 | 5 | 5 | 5 |
| D 1401 (time, minutes) | Characteristics @ 54° C. | >60 | 5 | 5 | 5 |

(a) All blends use Group II base stocks and contain similar chemistry and treat levels of antioxidant, antiwear, metal deactivator, and pour point depressant.
①Alkylphenolamine - (Mannich) dispersant
②Borated PIB dispersant
③Mixture of Alkenyl succinimide and trioleyl pentaerthyritol ester
④calcium dinonyl naphthelene sulfonate

What is claimed is:

1. A lubricant composition comprising:

(a) a lubricating oil base stock;

(b) an effective amount of a rust inhibitor additive combination consisting essentially of a metal containing sulfonate rust inhibitor and an ashless alkenyl succinimide rust inhibitor; and (c) an ashless borated polyolefin dispersant wherein the weight ratio of dispersant to additive combination is less than 1.14.

2. The composition of claim 1 wherein the ratio of dispersant to additive combination is in the range of 0.50 to 1.14.

3. The composition of claim 1 or 2 wherein the metal containing rust inhibitor is a Group 2*a* metal sulfonate.

4. The composition of claim 2 wherein the ashless dispersant is a borated polyisobutylene.

5. The composition of claim 4 wherein the alkenyl group of the alkenyl succinimide has from about 15 to about 30 carbon atoms.

6. The composition of claim 5 wherein the borated polyisobutylene has a weight average molecular weight in the range of from about 2000 to about 2500.

7. A lubricant composition comprising:

(a) a major amount of a natural mineral oil or mixture thereof having an ISO 10 to 1500 viscosity grade range;

(b) a rust inhibiting additive combination consisting essentially of from 0.2 to 0.4 wt %, of a calcium or barium alkenylaryl sulfonates and from 0.05 to 0.1 wt % of an alkenyl succinimide having alkenyl groups of from about 15 to about 30 carbon atoms; and (c) a borated polyolefin ashless dispersant in an amount ranging from about 0.2 to about 0.5 wt %, all wt % based on the total composition, the dispersant having a weight average molecular weight in the range of from about 2000 to about 2500.

8. A method for enhancing the antirust and demulsification properties of an industrial lubricant basestock; the method comprising blending in the basestock:

(a) an effective amount of a rust inhibitor additive combination consisting essentially of a metal containing sulfonate rust inhibitor and an ashless alkenyl succinimide rust inhibitor; and (b) an ashless borated polyolefin dispersant wherein the weight ratio of dispersant to additive combination is less than 1.14.

9. The method of claim 8 wherein the ratio of dispersant to additive combination is in the range of 0.50 to 1.14.

10. The method of claim 8 or 9 wherein the metal containing rust inhibitor is a Group 2*a* metal sulfonate.

11. The method of claim 10 wherein the ashless dispersant is a borated polyisobutylene.

12. The method of claim 11 wherein the alkenyl group of the alkenyl succinimide has from about 15 to about 30 carbon atoms.

13. The method of claim 12 wherein the borated polyisobutylene has a weight average molecular weight in the range of from about 2000 to about 2500.

* * * * *